US007263730B2

(12) United States Patent
Crawford

(10) Patent No.: US 7,263,730 B2
(45) Date of Patent: Sep. 4, 2007

(54) SLEEPING BAG

(76) Inventor: Darlisa Y. Crawford, 4215 N. Drinkwater Blvd., Suite 372, Scottsdale, AZ (US) 85251

( * ) Notice: Subject to any disclaimer, the term of this patent is extended or adjusted under 35 U.S.C. 154(b) by 0 days.

(21) Appl. No.: 11/244,914

(22) Filed: Oct. 5, 2005

(65) Prior Publication Data

US 2007/0061965 A1 Mar. 22, 2007

Related U.S. Application Data

(60) Provisional application No. 60/713,357, filed on Sep. 2, 2005.

(51) Int. Cl.
*A47G 9/08* (2006.01)

(52) U.S. Cl. ..... 5/413 R; 5/494

(58) Field of Classification Search ..... 5/413 R, 5/494, 416, 485; 297/219.12, 228.12, 219.1; 2/69.5

See application file for complete search history.

(56) References Cited

U.S. PATENT DOCUMENTS 1,929,263 A * 10/1933 Sork ..... 2/69.5
4,241,458 A * 12/1980 Lesesne ..... 2/69.5
4,507,805 A * 4/1985 Calutoiu ..... 2/69.5
6,012,189 A * 1/2000 Dudley ..... 5/655
6,105,168 A * 8/2000 Hazen ..... 2/69.5
6,145,932 A * 11/2000 Hamel-Nyhus et al. ..... 297/465
6,272,683 B1 * 8/2001 Symms et al. ..... 2/69.5
6,764,134 B1 * 7/2004 Crescenzi et al. ..... 297/219.12
2004/0019968 A1 * 2/2004 Vlassis et al. ..... 5/413 R

* cited by examiner

*Primary Examiner*—Michael Trettel
(74) *Attorney, Agent, or Firm*—Sughrue Mion, PLLC; Joseph Bach

(57) ABSTRACT

The sleeping bag is an insulated bag for covering and protecting the body of a user when the user is seated. The bag is formed from front and rear fabric sheets joined to one another and sized and shaped to receive the body of the user. At least one pair of slots is formed through the front fabric sheet to receive a seatbelt attached to a chair, such as an airplane seat, thus selectively securing both the user and the insulating bag to the seat. Alternatively, or in addition to the seatbelt slots, a pair of slots may be formed through the front fabric sheet for providing the user's hands free access to the external environment.

15 Claims, 10 Drawing Sheets

SLEEPING BAG

CROSS-REFERENCE TO RELATED APPLICATIONS

This regular U.S. patent application is based on and claims the benefit of U.S. Provisional Application No. 60/713,357, filed Sep. 2, 2005, the entire disclosure of which is relied upon and incorporated by reference herein.

BACKGROUND OF THE INVENTION

1. Field of the Invention

The present invention relates to sleeping bags, and particularly to a sleeping bag attachable to a chair or seat. In one embodiment, the sleeping bag includes at least one pair of slots for receiving a seatbelt, such as the seatbelt secured to an airplane seat, while in another embodiment the sleeping bag is adapted for attachment to a lounge chair and has a pair of slots therein so that a user may extend his or her hands out of the bag.

2. Description of the Related Art

Infants, toddlers, and even adults have a tendency to fall asleep while sitting for extended periods of time. Parents wish to provide a cover for their infant or toddler when the child has to sit in a stroller or automobile seat for extended periods of time to provide warmth and comfort for the child, as well as a modicum of protection to ward off colds. Similarly, adults often spend their leisure time reclining in a pool lounge chair, spa table, or the like, and may fall asleep, only to awaken prematurely when the temperature falls and they become chilly. In addition, both adults and children often spend considerable time in an aircraft seat, and face the same considerations with regard to warmth and comfort while sleeping in the aircraft seat on long flights.

Portable covers have been provided for use with baby carriages, wheelchairs and the like in order to provide warmth and protection for the user. However, such covers typically only cover one portion of the user's body, such as the user's legs, rather than providing warmth and protection for the user's entire body. Such portable covers are generally in the form of blankets for only covering one region of the user's body. Even with the addition of some sort of fastener to hold the blanket to the seat, blankets easily shift and become misaligned, not only diminishing the functionality of the blanket, but causing discomfort for the user. In addition, on airline seats or infant automobile seats, it is difficult to make provision for using seat belts with such covers, and still further, leaving the buckled seat belt readily visible while the cover is in use.

Thus, a sleeping bag solving the aforementioned problems is desired.

SUMMARY

The sleeping bag is an insulated bag or full body wrapper for providing warmth and comfort to a user when occupying a seat or chair, including a lounge chair for poolside. The insulated bag may be formed from front and rear fabric sheets joined to one another and sized and shaped to receive the entire body of the user. At least one pair of slots is formed through the front fabric sheet. In one embodiment, the slots receive a seatbelt attached to a seat, such as an airplane or automobile seat, and in another embodiment, the bag has a pair of slots so that the belt is exposed to make it readily apparent that the belt is buckled. In another embodiment, the slots permit the user to extend his or her hands outside the bag, e.g., for use with a lounge chair. Both pairs of slots may be provided to enable using a seat belt and permitting extending the hands through the bag.

A rear pair of slots may be formed through the rear fabric sheet, allowing the belt to pass through the bag. An opening is further formed through the front fabric sheet dimensioned and configured to allow the user to place his or her body within the bag. A releasable fastener, such as a zipper, is secured to the front fabric sheet for selectively and adjustably sealing the opening.

According to an aspect of the invention, securing loops are provided on the sleeping bag to enable threading the seat belt through the loops, much like a belt is threaded through loops in trousers. In this manner, the seatbelt is visible for inspection.

According to another aspect of the invention, a pillow is provided at the top side of the sleeping bag.

According to yet another feature of the invention, a pair of openings is provided to enable the user to expose the user's arm while inside the bag. According to one embodiment, the openings are provided with fasteners, such as zippers/magnets, so that they can be closed when not in use.

According to yet another feature, a hood is provided at the top side of the sleeping bag, to enable the user to cover the user's head.

According to further features the sleeping bag is provided with a securing mechanism, enabling securing the bag to the seat.

These and other features of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION

Figure 1:
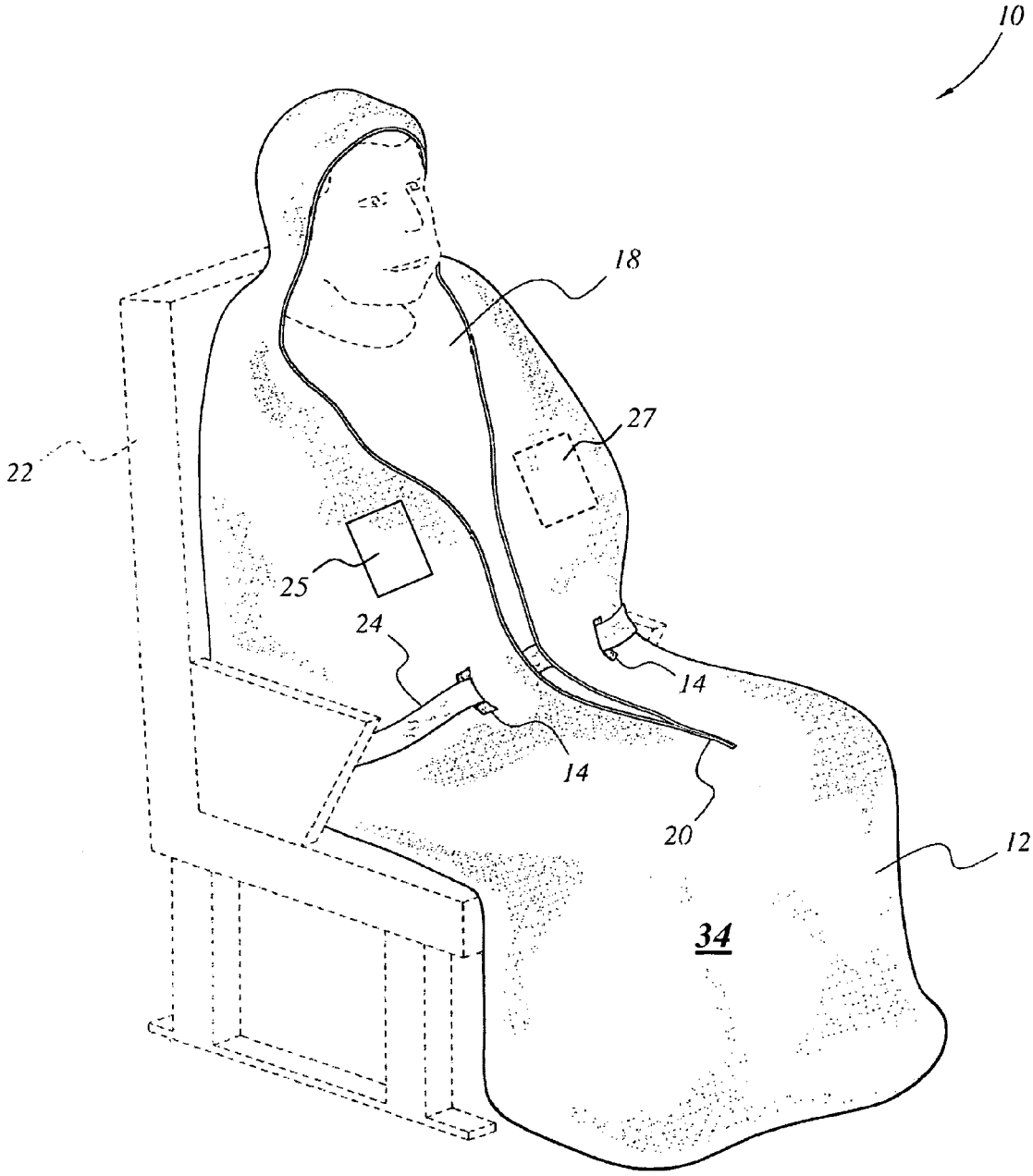
FIG. 1 is an environmental, perspective view of a first embodiment sleeping bag according to the present invention in use with a seat having a seatbelt, such as an aircraft or automobile seat.
Figure 2:
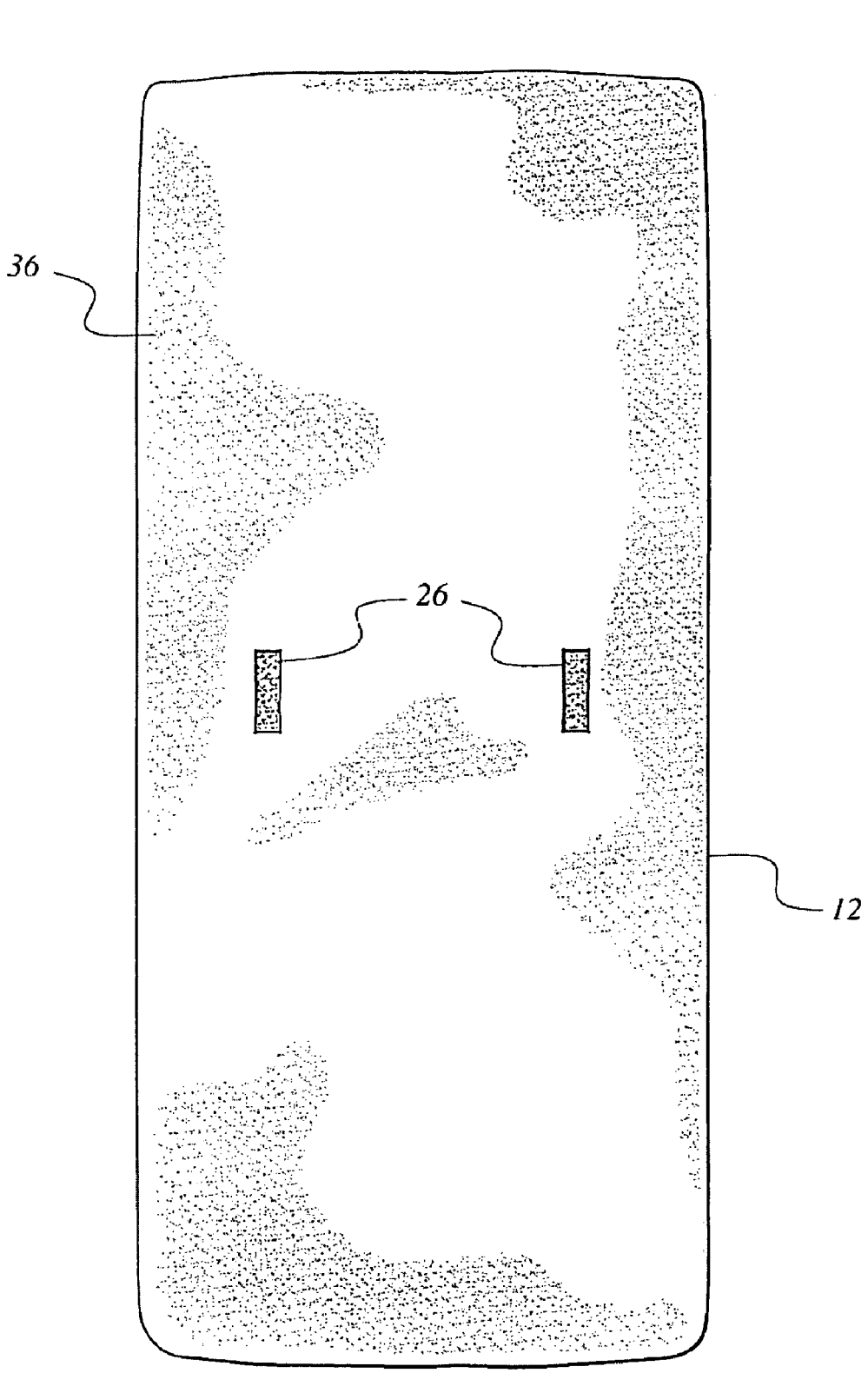
FIG. 2 is a rear view of the sleeping bag of FIG. 1.

As shown in FIGS. 1 and 2, a first embodiment of the sleeping bag 10 of the present invention is a bag 12 sized and dimensioned to contain the body of a user. Bag 12 is adapted for secure connection to a chair with a seatbelt or strap 24 secured to chair 22. Bag 12 has a first pair of slots 14 formed therethrough, which are sized and contoured to securely receive seatbelt 24, thus providing releasable attachment of bag 12 and the user to chair 22. Although shown as being adapted for use with a conventional commercial airplane seat 22 having a standard seatbelt 24, it should be understood that bag 12 may be used with any suitable chair or other support surface having any type of strap, belt or other similar releasable fastener.

Bag 12 includes front and rear fabric sheets 34, 36, joined to one another to form a hollow enclosure for receiving and covering the body of the user. Front and rear fabric sheets 34, 36 may be joined to one another through stitching or any other suitable process. Of course, other manners of forming the bag may be used, such as, e.g., folding a single sheet and stitching it so as to form a bag. Therefore, it should be understood that the front and rear fabric sheets may be made from a single sheet of fabric; however, for clarity of description, reference will be made herein to front and rear fabric sheets. Front and rear fabric sheets 34, 36 provide thermal insulation and protection for the user and may be formed as multi-layer structures, including outer fabric layers sandwiching additional layers of thermally insulating material, such as is often found in conventional sleeping bags. The material composition of front and rear fabric sheets 34, 36 is dependent upon the needs and desires of the user.

Front and rear fabric sheets 34, 36 are sized and shaped to provide a secure and comfortable cover for the user's legs and upper torso. In one embodiment, the bag 12 is about seven feet in length, being dimensioned to enclose the entire body from head to foot. In manufacture, front and rear fabric sheets 34, 36 may be produced in a variety of shapes and sizes to provide a variety of shapes and sizes of bags 12, allowing the user to select an appropriate size and shape dependent upon the user's specific body type.

Figure 3A:
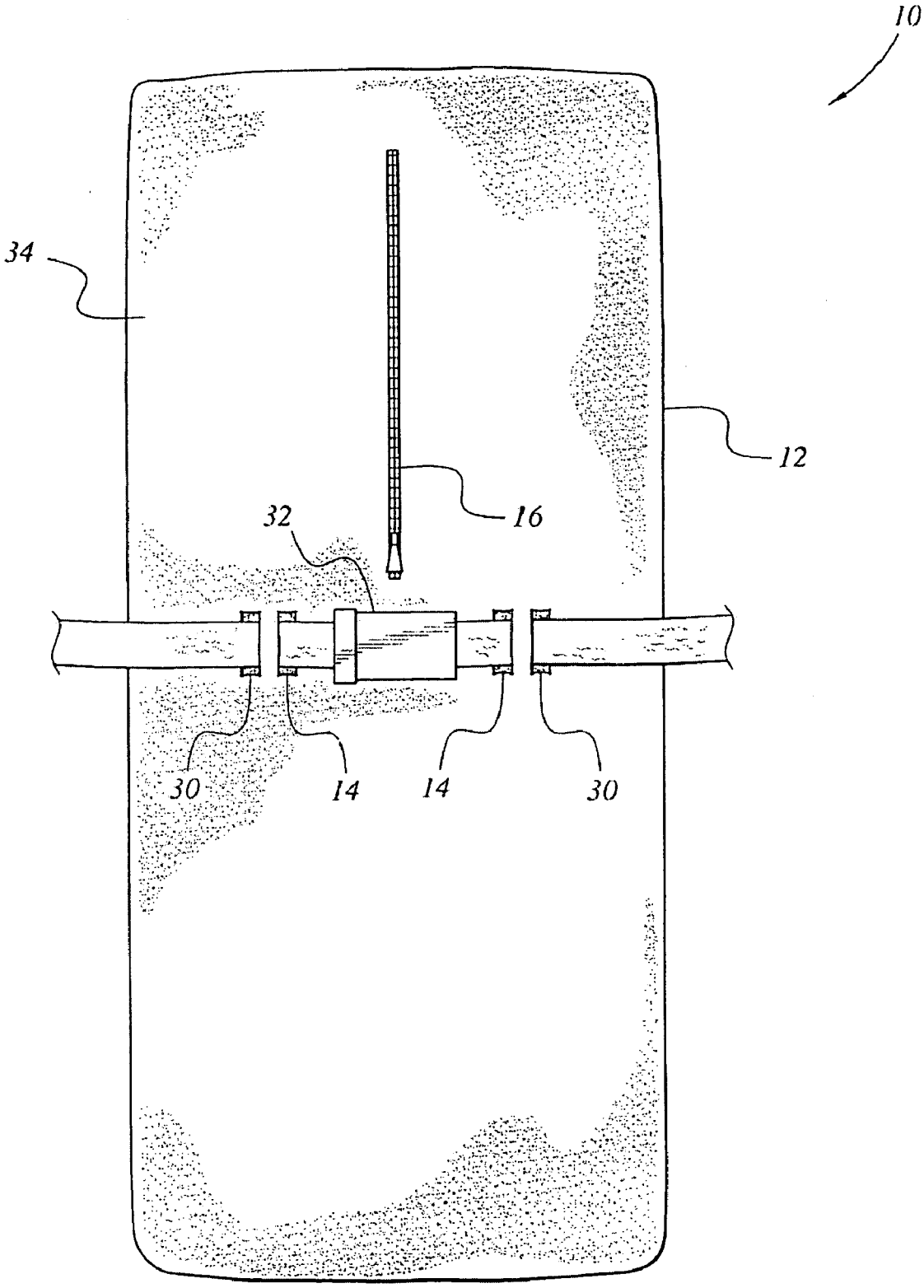
FIGS. 3A and 3B are front views of alternative embodiments of a sleeping bag according to the present invention.
Figure 3B:
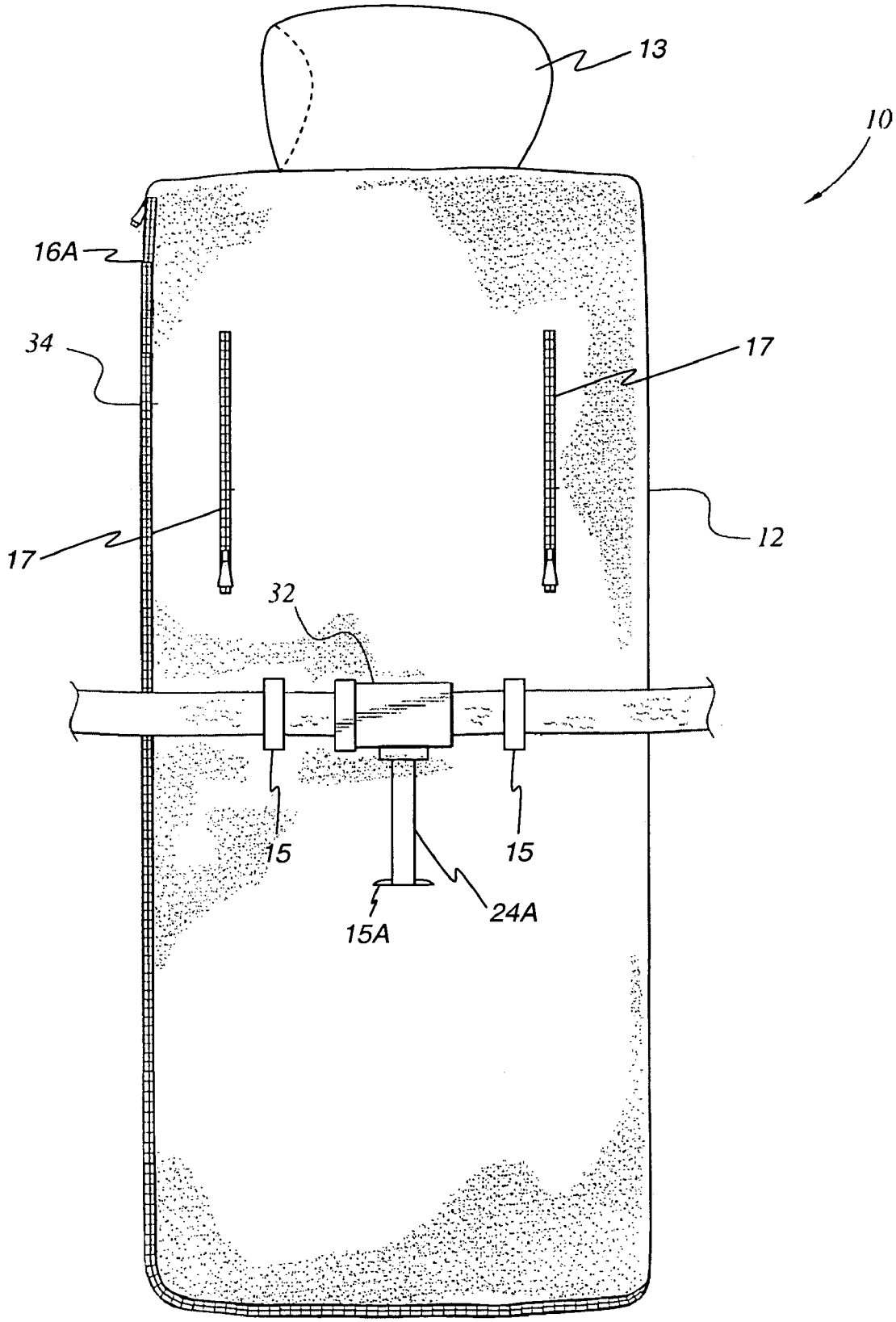

Front fabric sheet 34 has a first pair of slots 14 formed therethrough for receiving seatbelt 24 and securing bag 12 to chair 22. As shown in FIG. 1, the central portion of seatbelt 24 is received within the interior 18 of bag 12 for directly contacting the body of the user. However, under certain circumstances, it may be desirable to have the central portion of seatbelt 24 exposed on the exterior of bag 12, as shown in FIGS. 3A and 3B. For example, commercial airline regulations require the buckle 32 of seatbelt 24, attached to airplane seat 22, to be visible, allowing the aircrew to confirm that passengers are safely buckled into their seats. As shown in FIG. 3A, a second pair of slots 30 may be formed through front fabric sheet 34, allowing seatbelt 24 to be threaded through first and second pairs of slots 14, 30 so that buckle 32 is centrally located on the exterior of front fabric sheet 34 of bag 12. Of course, rather than using slots, loops 15 may be provided as shown in FIG. 3B. The loops may be fabric loops similar to that conventionally provided for pants belt. In this manner, the interior of the sleeping bag remains sealed even when a seatbelt is used to secure the user to the seat.

Referring back to FIG. 1, front fabric sheet 34 further has an opening 20 formed therethrough, sized to allow the user easy access to the interior region 18 of bag 12. As shown in FIG. 3A, a fastener 16 may be secured to front fabric sheet 34 on the periphery of opening 20, allowing the user to selectively seal opening 20. Fastener 16 is shown as a zipper in FIG. 3A. However, it should be understood that any suitable releasable and adjustable fastening device may be utilized.

Opening 20 is shown as being formed both vertically and centrally with respect to front fabric sheet 34. However, this is for exemplary purposes only, and opening 20 may be formed in any desired position with respect to front fabric sheet 34, depending on the needs and desires of the user. Opening 20 should be sized and shaped to allow the user easy ingress to, and egress from, interior region 18 of bag 12, and should further allow for easy sealing by fastener 16. In FIG. 1, opening 20 is shown as extending from the user's head to below the user's waist. However, as shown in FIG. 3A, opening 20 may extend only partially down the torso of the user. The length, size and contouring of opening 20 are dependent upon the needs and desires of the user. For Example, FIG. 3B depicts an embodiment wherein the zipper 16A extends through the entire length of the side and bottom of the sleeping bag. That is, the sleeping bag may be made of a single rectangular flat sheet, having a zipper sawn as shown in FIG. 3B. In this manner, when the zipper is zipped, the flat sheet turns into a bag.

As shown in FIG. 2, a pair of rear slots 26 may be formed through rear fabric sheet 36. Rear slots 26 are aligned with front slots 14 and allow the user to selectively secure bag 12 to chair 22 through the reception of seatbelt 24 by rear slots 26, rather than front slots 14 of front fabric sheet 34. The selection of rear slots 26 or front slots 14, by the user, is dependent upon the type of chair 22, the type of strap or belt 24, and the specific desires of the user.

Figure 7:
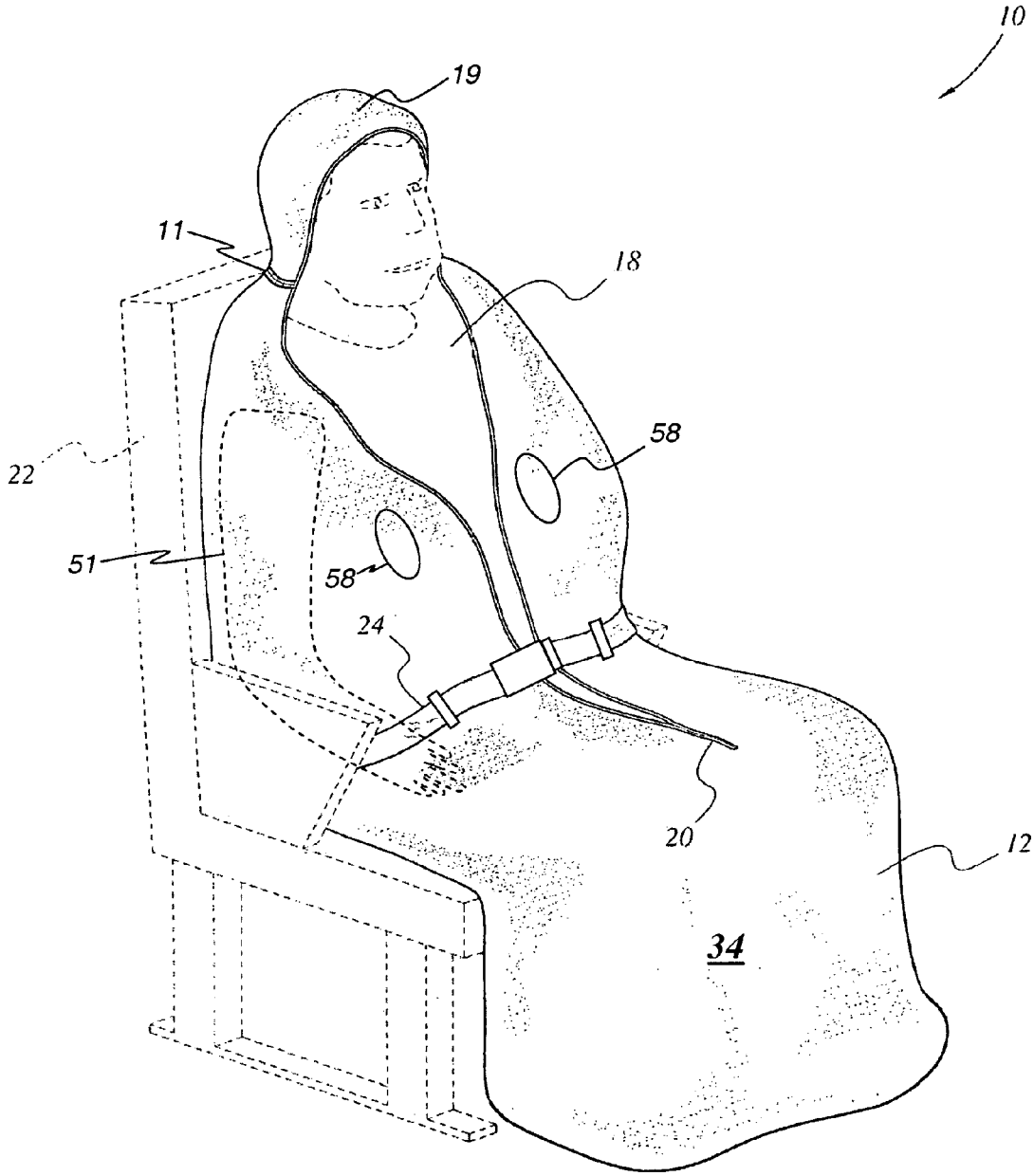
FIG. 7 is an environmental, perspective view of another embodiment sleeping bag according to the present invention in use with a seat having a seatbelt, such as an aircraft or automobile seat.

Although FIG. 1 illustrates the bag 12 covering the user's head, forming a hooded protective covering, it should be understood that bag 12 may be worn so that the user's head freely projects through opening 18. The user may wear bag 12 to cover as much of the user's body as the user finds desirable. An example is shown in FIG. 7, wherein the bag is made to reach the user's neck, but it also includes a hood 19 in case the user would like to cover the user's head. In the shown example of FIG. 7 the hood is removable via zipper 11, although other embodiments may be envisioned. For example, the hood may be permanently attached to the sleeping bag and removable attached to the sleeping bag using various mechanisms, such as, e.g., hook-and-loop mechanism generally known as Velcro®. Velcro is a registered mark of Velcro Industries B.V. Ltd., LIAB Co. The Netherlands. In addition, although shown as being used with a conventional aircraft-type seat, it should be understood that the user may wear bag 12 in any suitable environment, such as in an automobile, on a yacht, in a sports stadium, on a train, in the outdoors or in any other environment where bodily protection is desired or necessitated.

FIG. 3B illustrates other features of the inventive sleeping bag. For example, the sleeping bag may also be provided with a pillow 13. The pillow 13 may be permanently or detachably attached to the sleeping bag, much like the hood 19 of FIG. 7. Also, zippered openings 17 are provided to enable the user to extend the user's hands through the openings. When the user does not need to extend the hands, the user may zip the openings shut so that warm air may not escape from the bag through the openings. Another optional feature is the provision of opening 15A, enabling the use of a 3-point seatbelt. Opening 15A is provided both in the front and rear, so that a third-point belt 24A can be threaded through the bag 10. As is known, 3-point seat belts are used in various seats, such as strollers, toddler car seats, high chairs etc. In such cases, the opening 15A, can be used for the third-point belt.

Figure 4:
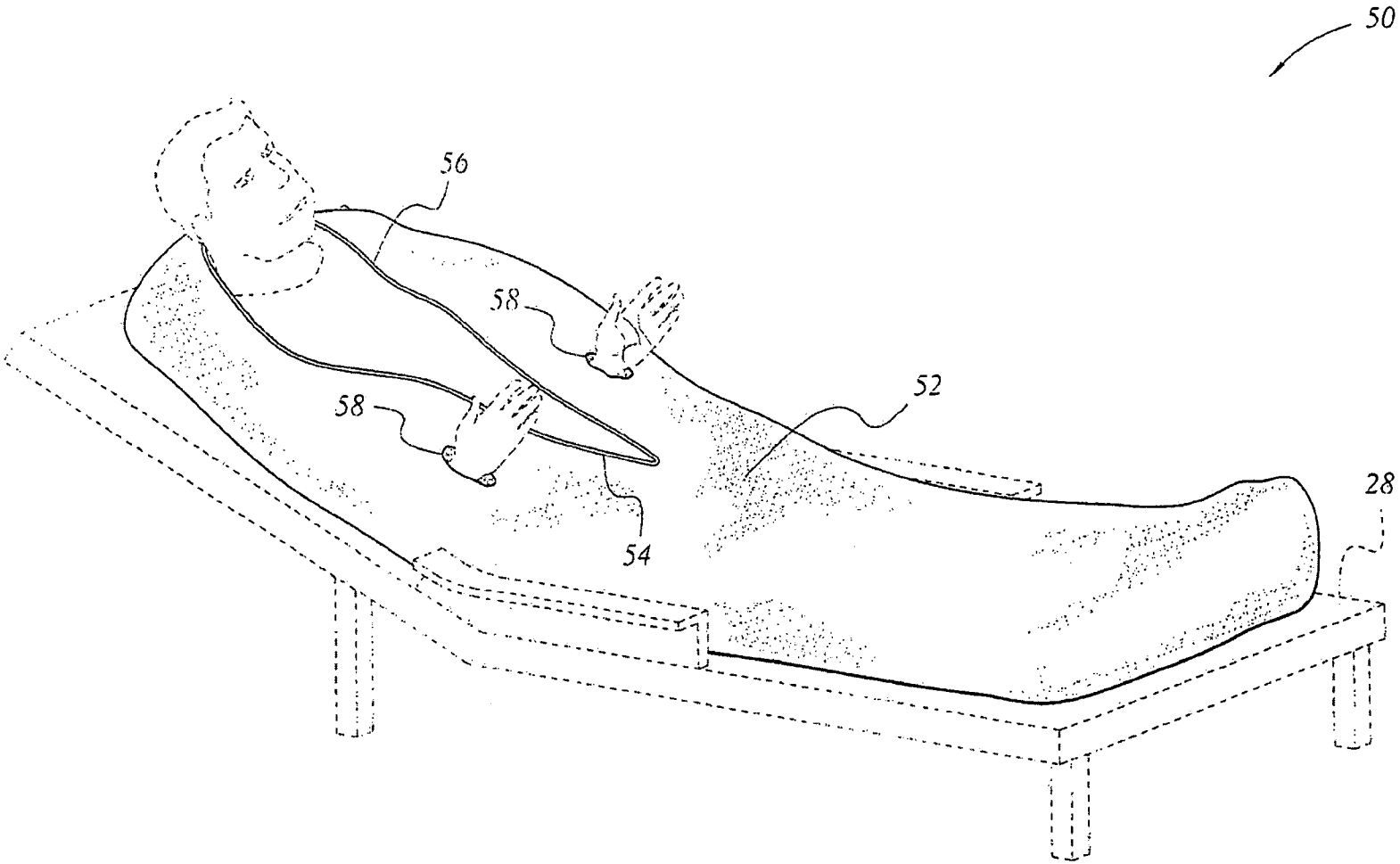
FIG. 4 is an environmental, perspective view of another alternative embodiment of a sleeping bag according to the present invention.

In the alternative embodiment illustrated in FIG. 4, a sleeping bag for use with a chair 50 includes a bag 52, similar to bag 12 of any of the embodiments shown in FIGS. 1-3B. Bag 52 has an opening 54 formed therethrough for providing the user access to the interior of bag 52, and further includes a releasable fastener 56, similar to fastener 16 of FIG. 3A or fastener 16A of FIG. 3B.

Bag 52 has a pair of slots 58 formed therethrough for receiving the hands of the user. As shown in FIG. 4, when the user is positioned within the interior of bag 52, the user's hands project through slots 58, allowing the user access to the exterior of bag 52. The external positioning of the user's hands with respect to bag 52 allows the user to scratch himself or herself, adjust the bag 52 for comfort, or allows the user to engage in any desired activity requiring the user's hands to be free. Slots 58 are sized and contoured to comfortably receive the user's hands and are positioned at approximately waist-level with respect to the user's body when the user is housed within bag 52. As in the embodiment of FIG. 3B, the openings may be provided with a fastening mechanism, such as a zipper.

Bag 52 is formed of thermal insulation material and may be used with a lounge chair 28, or any other suitable support surface. Bag 52 may also be formed of similar materials as those used in the construction of sleeping bag 10, or may be constructed of materials selected for specific environmental needs. For example, when used in combination with the beach or lounge chair 28 shown in FIG. 4, it may be desired to form bag 52 from terry cloth or similar materials. Other examples of materials for bag 52 are mosquito net-type fabric, disposable plastic or paper-based fabric, etc. The materials selected to form bag 52 are dependent upon the specific needs and desires of the user.

Bag 52, shown in FIG. 4, may be adapted for use with any suitable support surface, such as, but not limited to, a lounge chair, an aircraft seat, a baby crib, a hospital bed or the floor. Additionally, it should be understood that the sleeping bag 12 of the embodiment of FIG. 1 could include hand-receiving slots similar to slots 58 of the embodiment of FIG. 4. Such an example is shown in FIG. 7, wherein hand slots 58 are provided in addition to slots 14, used for the seatbelt.

Figure 5:
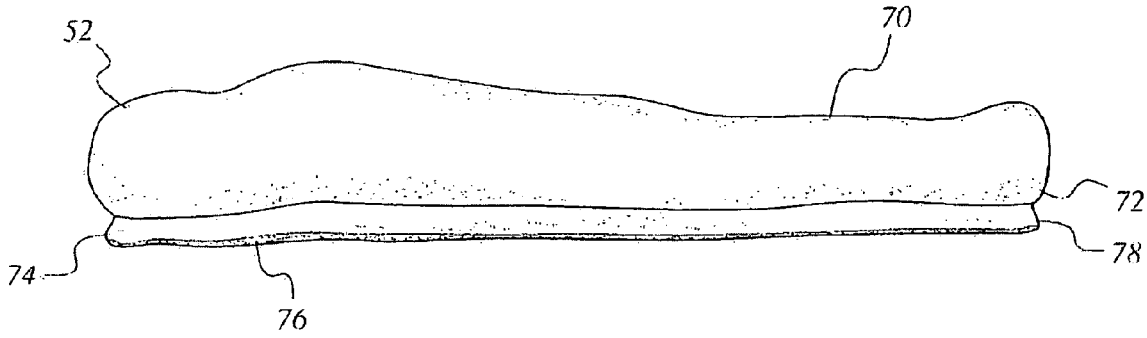
FIG. 5 is a side view of another alternative embodiment of a sleeping bag according to the present invention.

Alternatively, bag 52 may be contoured for engagement with a specific support surface. In the embodiment shown in FIG. 5, bag 52 is formed from a front sheet 70 and a rear sheet 72, similar to the front and rear fabric sheets of bag 12, shown in FIGS. 1-4. Rear sheet 72 has an engaging cover 74 depending therefrom and joined thereto through stitching or any other conventional attachment method. Cover 74 is similar to a conventional fitted sheet or mattress cover, and forms an opening 76 defined by an elastic perimeter 78.

Figure 6:
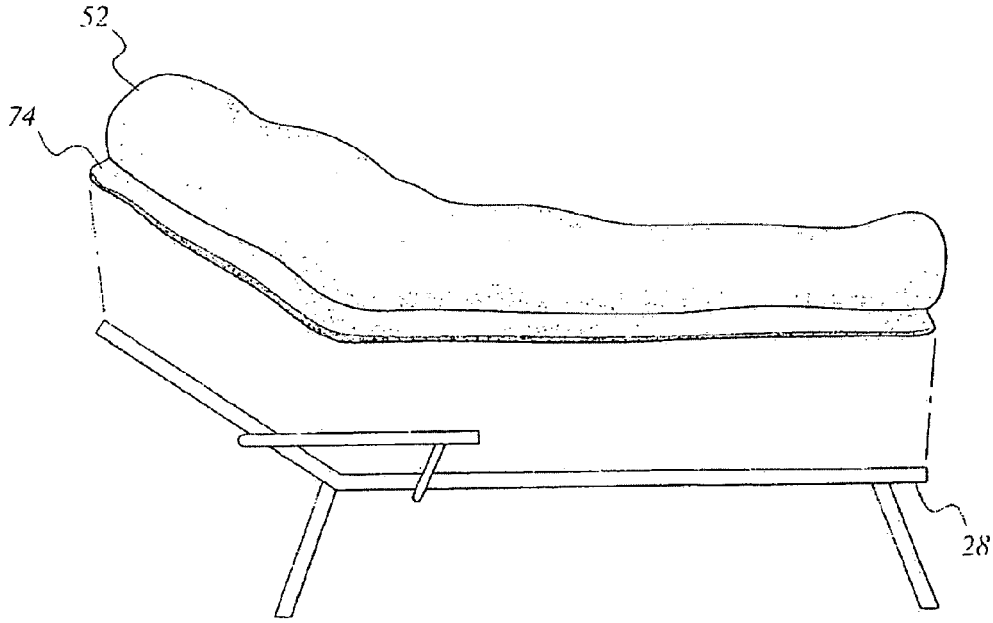
FIG. 6 is an environmental side view of the embodiment of the sleeping bag shown in FIG. 5, showing attachment of the bag to a lounge chair.

As shown in FIG. 6, cover 74 engages lounge chair 28 in order to releasably secure bag 52 to the chair 28. Alternatively, rear sheet 72 and engaging cover 74 could be formed as a single fabric sheet, contoured to form opening 76 for engaging chair 28. Though shown as being applied to lounge chair 28, it should be understood that cover 74 may be contoured to engage any suitable support surface. For example, the bag 52 may be used in baby cribs, hospital beds, emergency stretchers, etc. For each such application, the bag would be made from an appropriate material.

Further, FIG. 4 illustrates the bag 52 providing the user's head free access to the external environment. The bag 52 may be worn in a manner similar to that shown in FIG. 1; i.e., the bag 52 may be worn to partially cover the user's head. The amount of body coverage of the bag 52 is dependent upon the needs and desires of the user. As shown in other examples herein, the bag may be provided with a hood or pillow, either permanently or detachably attached to the bag.

Bags 12 and 52 provide the user with warmth and protection in any environment and are adapted to be used with any type of seat or other support surface. The sleeping bag 10 allows the user to secure bag 12 to a chair 22 through the use of a seatbelt or strap 24, thus providing greater adaptability of sleeping bag 10 (in that the sleeping bag 10 may be used in situations where seatbelts are necessary, such as in an airplane or automobile), and providing for additional safety for the user. Insulated bag 52 is adapted for use with any type of chair or support surface, and provides free access to the external environment for the user's hands, allowing the user to engage in any desired activity requiring free movement of the hands.

The sleeping bags of the present invention may be made from any desired material. In one embodiment, the bag may be made from a light cashmere fabric for a posh appearance. In another embodiment, the bag may be made from a heavier, down-filled fabric. In yet another embodiment, the bag may be made from terry cloth, similar to the material used to form spa towels and robes. Alternatively, the bag may be formed from a resilient material, such as nylon, particularly for military applications.

Figure 8:
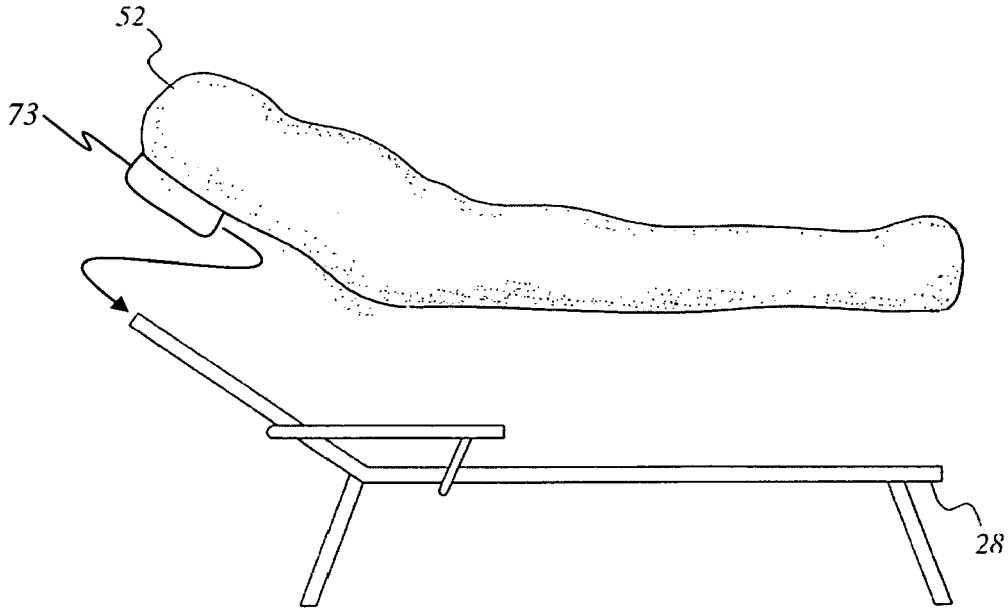
FIG. 8 is an environmental side view of an embodiment of the sleeping bag showing alternative attachment of the bag to a lounge chair.
Figure 9:
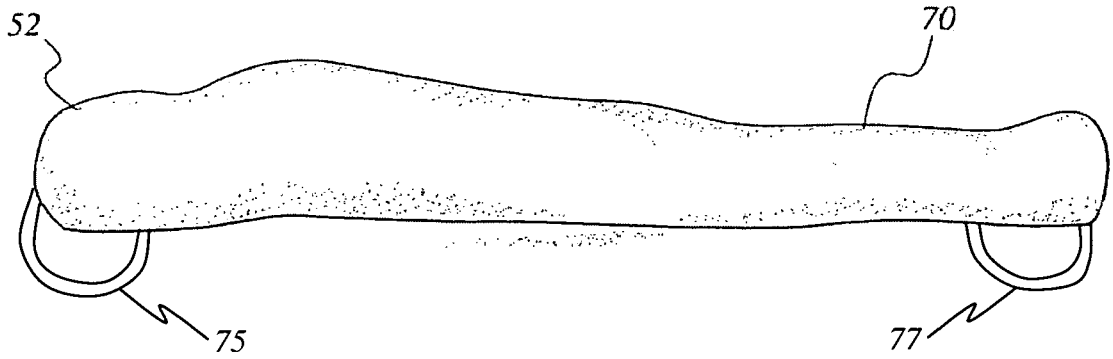
FIG. 9 is an environmental side view of an embodiment of the sleeping bag showing yet another alternative attachment of the bag to a lounge chair.

According to yet another embodiment, shown in FIG. 8, the sleeping bag is provided with a "reverse" pocket 73. The reverse pocket can be slid over a top portion of a chair or seat, e.g., a head rest of a car or plane seat, so as to secure the bag to the seat. Instead of, or in addition to the reverse pocket, elastic band 75 may be provided to enable securing the bag to a chair or a seat, as shown in FIG. 9. An additional band 77 may be provided to secure the lower part of the bag, also shown in FIG. 9.

Figure 10:
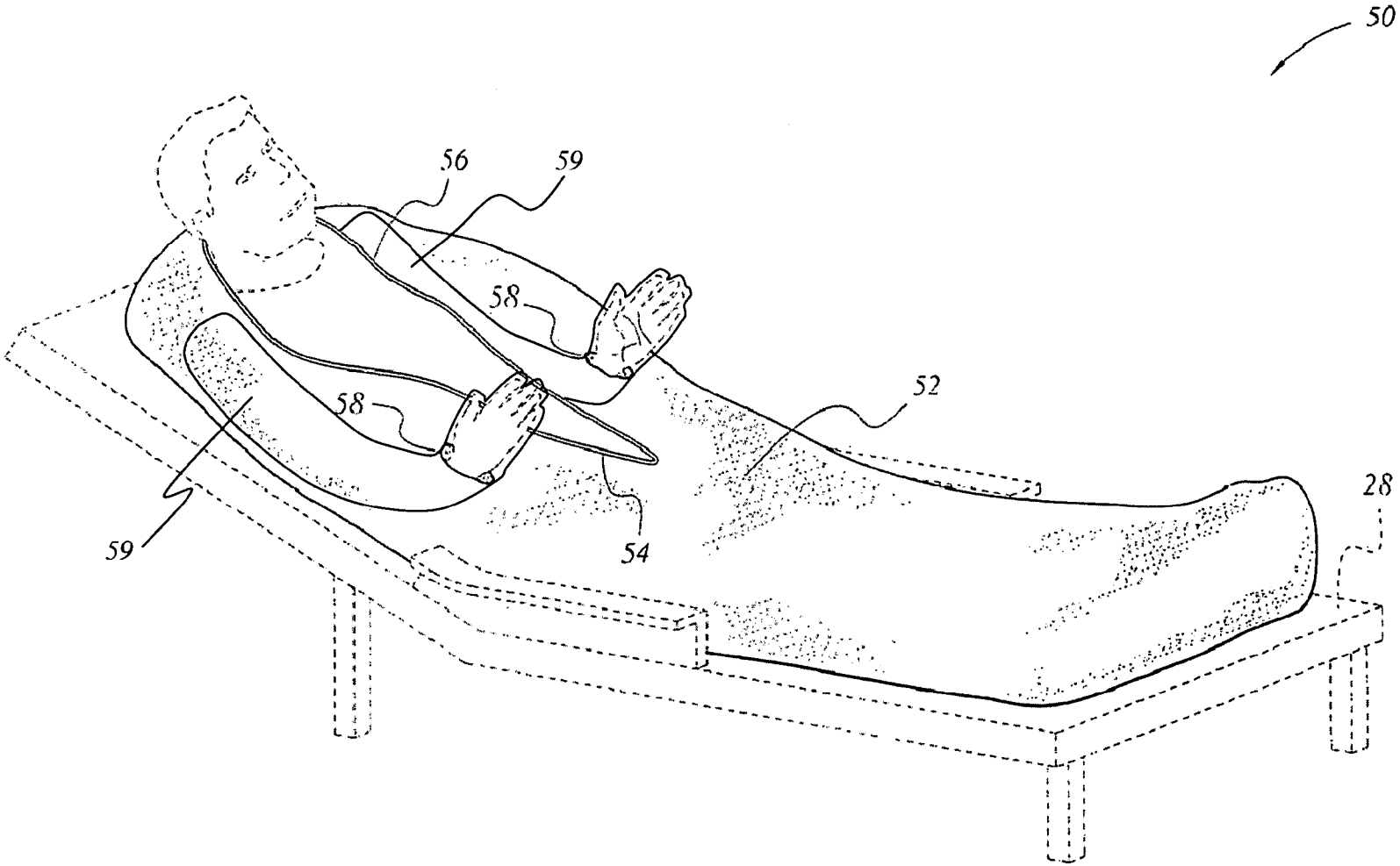
FIG. 10 is an environmental, perspective view of another alternative embodiment of a sleeping bag according to the present invention.

Yet another embodiment is depicted in FIG. 10. The embodiment of FIG. 10 is most usable for areas where insects, such as mosquitoes abound. According to this embodiment, the bag is made of a mosquito net-type fabric. In order to prevent mosquitoes from entering the bag, rather than providing holes for the hands, gloved-sleeves 59 are attached to the bag. The gloved sleeves may be made of the same net material as the bag. Such gloved sleeves enable the user free movements of the hands, but without breaching the security provided by the bag. As can be understood, the end of the sleeves can be made as a glove or a mitten. On the other hand, the sleeve can be made open, without a glove or mitten. Further yet, the sleeve can be made with a removable glove or mitten. Of course, any of the embodiments shown herein may be provided with such sleeves. For example, an optional sleeve 51 is shown in the embodiment of FIG. 7. The sleeves can be permanently or detachably connected to the bag.

According to another embodiment, the sleeping bag further includes a pocket, which may be an external pocket or internal pocket. This is shown in FIG. 1 as external pocket 25 and internal pocket 27 (shown in broken line). Of course, both internal and external pockets may be provided. The pockets may be used for holding personal papers or personal articles. According to one embodiment, the exterior of pocket 25 is made of a clear material so that documents therein are visible. This can be used, for example, to display airline or train ticket, etc. The pockets may have sealing mechanism, such as a zipper, Velcro®, etc.

As can be understood, any of the embodiments shown herein may be made of a disposable materials for single use purposes. For example, when used in a hospital bed, in a rescue stretcher, etc. On the other hand, when used in exposed or bad weather conditions, the bag may be made of a nylon material or nylon backing or exterior.

Figure 11:
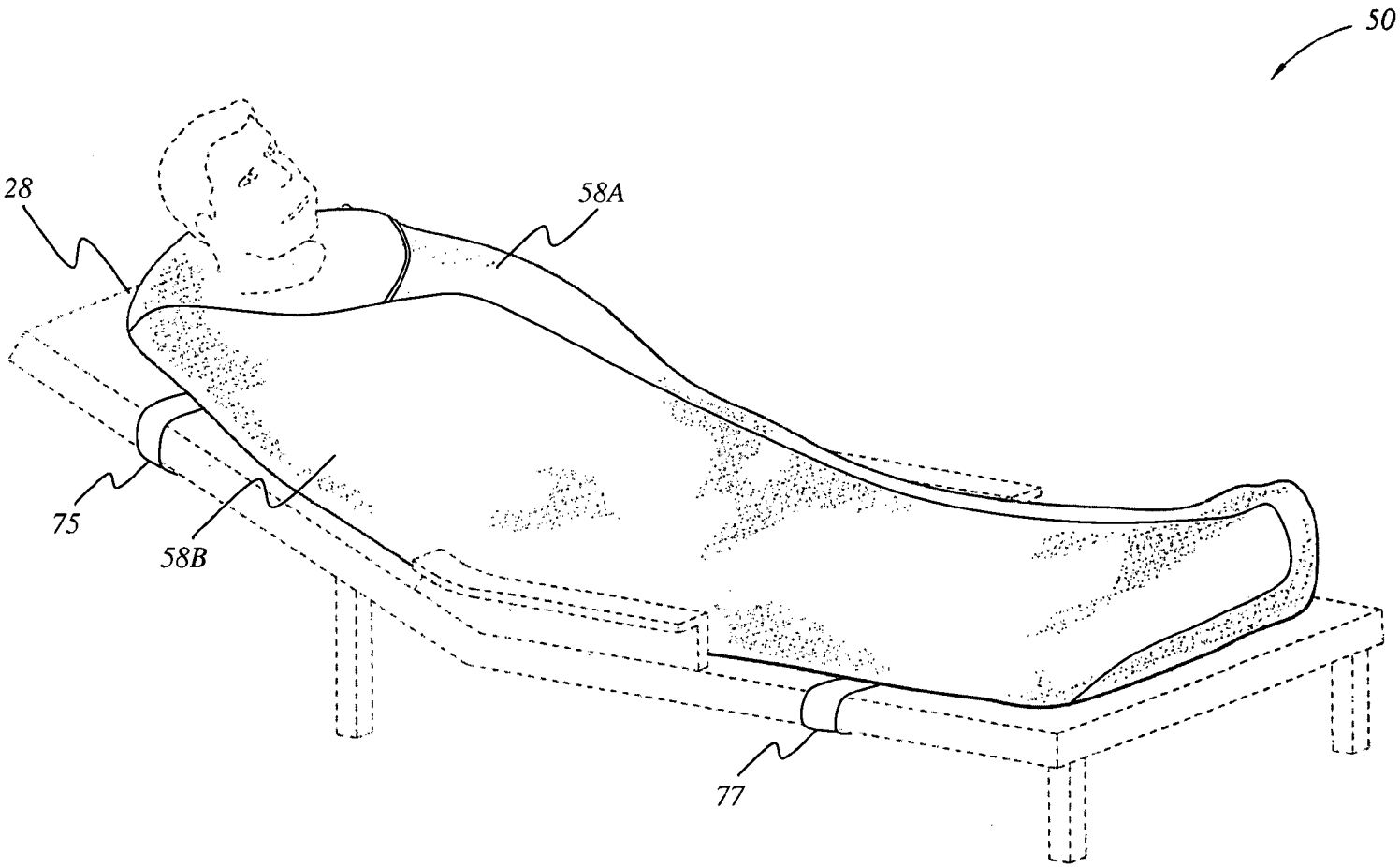
FIG. 11 is an environmental, perspective view of another alternative embodiment of a sleeping bag according to the present invention.

Yet another embodiment is shown in FIG. 11. As shown in FIG. 11, sleeping bag 50 has a securing mechanism, such as elastic bands 75 and 77, attached to a rear side to secure the bag to the resting chair 28. Other securing mechanisms may be used, such as Velcro® bands, etc. The resting apparatus may be a lawn chair, a hospital bed, a rescue stretcher, etc. According to this particular embodiment, a first leaf cover 58A and a second leaf cover 58B are provided to cover the user's body in a manner illustrated in FIG. 11. That is, as the user places the user's body on the bag 50, the user first coven the front body using leaf cover 58A, and then uses leaf cover 58B to cover the rest of the body, in an overlapping manner to leaf cover 58A. In this manner, easy access to the entire body is made available. This is beneficial especially in situations where the user is a patient in a hospital, in a rescue situation, etc. Optionally, leaf covers 58A and 58B can be mated together using fastening mechanism, such as Velcro®, etc.

It is to be understood that the present invention is not limited to the embodiments described above, but encompasses any and all embodiments within the scope of the following claims. For example, any of the embodiments depicted may be adapted for use with any suitable support surface, such as, but not limited to, a lounge chair, an aircraft seat, double aircraft seats next to each other, a baby crib, a hospital bed, train seat, etc. Similarly, in any of the disclosed embodiments the fasteners may be zippers, Velcro®, buttons, magnets etc.

I claim:

1. A sleeping bag for use with a seat having a seatbelt, comprising:

a bag-shaped fabric having a front side and a rear side for receiving and covering the body of a user, the front side having an opening formed therethrough for providing access to an interior region of the bag;

A plurality of loops provided on the exterior of the front side of the bag for receiving the seatbelt and securing the bag and the user to the seat and keeping the belt exposed to make it readily apparent that the belt is buckled.

2. The sleeping bag as recited in claim 1, further comprising a hood.

3. The sleeping bag as recited in claim 1, further comprising a pocket.

4. The sleeping bag as recited in claim 3, wherein said pocket is provided on the exterior side of said front side.

5. The sleeping bag as recited in claim 3, wherein said pocket is provided on the interior side of said front side.

6. A sleeping bag for use with a seat having a seatbelt, comprising:

front and rear fabric sheets joined together to form a bag for receiving and covering the body of a user, the front fabric sheet having a pair of slots formed therethrough adapted for selectively receiving the hands of the user when the user is housed within said bag, the pair of slots providing the user's hands with access to the external environment; and, a plurality of loops provided on the exterior of the front fabric sheet for receiving the seatbelt and securing the bag and the user to the seat and keeping the belt exposed to make it readily apparent that the belt is buckled.

7. The sleeping bag of claim 6, further comprising seat attachment mechanism to enable securing the bag to the seat.

8. The sleeping bag of claim 7, wherein said attachment mechanism comprises reverse pocket.

9. The sleeping bag of claim 7, wherein said attachment mechanism comprises elastic bands.

10. The sleeping bag of claim 7, wherein said attachment mechanism comprises an engaging cover having an elastic band provided on perimeter thereof.

11. The sleeping bag of claim 6 further comprising a pocket provided on the interior of the front fabric sheet.

12. The sleeping bag of claim 6, further comprising sleeves attached to said pair of slits.

13. The sleeping bag of claim 6, further comprising a pocket.

14. The sleeping bag of claim 6, further comprising a pair of zippers applied to said pair of slots, respectively.

15. The sleeping bag of claim 6, further comprising a pillow attached to the upper section of the bag.

* * * * *